US009914012B2

(12) United States Patent
Walter et al.

(10) Patent No.: US 9,914,012 B2
(45) Date of Patent: Mar. 13, 2018

(54) TREADMILL BELTS THAT ENHANCE A USERS COMFORT AND STABILITY

(71) Applicants: Clark Walter, Washington, NJ (US); Doris J. Walter, Washington, NJ (US)

(72) Inventors: Clark Walter, Washington, NJ (US); Doris J. Walter, Washington, NJ (US)

( * ) Notice: Subject to any disclaimer, the term of this patent is extended or adjusted under 35 U.S.C. 154(b) by 0 days.

(21) Appl. No.: 15/472,821

(22) Filed: Mar. 29, 2017

(65) Prior Publication Data

US 2017/0282006 A1 Oct. 5, 2017

Related U.S. Application Data

(60) Provisional application No. 62/315,234, filed on Mar. 30, 2016.

(51) Int. Cl.
*A63B 21/00* (2006.01)
*A63B 22/02* (2006.01)

(52) U.S. Cl.
CPC ..... *A63B 21/4039* (2015.10); *A63B 22/02* (2013.01)

(58) Field of Classification Search
CPC ..... A63B 21/00043; A63B 21/00069; A63B 21/00076; A63B 21/00178; A63B 21/00181; A63B 21/00185; A63B 21/002; A63B 21/0023; A63B 21/04; A63B 21/0407; A63B 21/0414; A63B 21/0421; A63B 21/0428; A63B 21/0435; A63B 21/0442; A63B 21/055; A63B 21/0552; A63B 21/0555; A63B 21/0557; A63B 21/065; A63B 21/068; A63B 21/16; A63B 21/4009; A63B 21/4023; A63B 21/4025; A63B 21/4027; A63B 21/4039; A63B 22/02; A63B 23/0205; A63B 23/0216; A63B 23/035; A63B 23/03516; A63B 23/04; A63B 23/0405; A63B 23/047; A63B 23/0482; A63B 23/0494; A63B 26/003; A63B 2069/0037; A63B 71/0054; A63B 2071/0063; A63B 2071/0072; A63B 2208/0204; A63B 2225/09; A63B 26/00; A63B 69/002; A63B 69/0035; A63B 69/0057; A63B 69/0059; A63B 69/0064; A63B 2225/093
See application file for complete search history.

(56) References Cited

U.S. PATENT DOCUMENTS 1,766,089 A * 6/1930 Wood ..... A63B 22/02 482/54
2,017,128 A * 10/1935 O'Neill, Jr. ..... A63B 22/02 482/54

(Continued)

*Primary Examiner* — Andrew S Lo
*Assistant Examiner* — Gary D Urbiel Goldner
(74) *Attorney, Agent, or Firm* — Joseph E. Maenner; Maenner & Associates, LLC

(57) ABSTRACT

A treadmill comfort belt includes a strap having a first end portion and a second end portion. Each of the first end portion and the second end portion has a securing member. A lumbar support portion is disposed between the first end portion and the second end portion. A compressible sleeve is disposed over the lumbar support portion. A collar is slidingly disposed over the first end portion and the second end portion. The collar is adapted to slide between the securing members and the sleeve. A method of using the belt is also provided.

15 Claims, 22 Drawing Sheets

(56) References Cited

U.S. PATENT DOCUMENTS 4,441,707 A * 4/1984 Bosch ..... A63B 21/151 482/131
5,158,510 A 10/1992 Lemire
5,176,597 A * 1/1993 Bryne ..... A61H 3/008 482/54
5,209,712 A * 5/1993 Ferri ..... A61H 1/02 482/131
5,234,392 A * 8/1993 Clark ..... A63B 69/0035 482/112
5,514,059 A * 5/1996 Romney ..... A63B 21/0004 482/121
5,681,248 A * 10/1997 Vani ..... A63B 21/0004 482/10
5,704,880 A * 1/1998 Amatulle ..... A63B 21/4009 482/124
5,769,764 A * 6/1998 Tilberis ..... A63B 23/03575 482/124
5,919,119 A * 7/1999 Bohmer ..... A63B 22/02 482/54
6,059,696 A 5/2000 Bohmer et al.
6,123,649 A * 9/2000 Lee ..... A63B 21/153 482/51
6,126,575 A * 10/2000 Wang ..... A63B 22/0257 482/51
6,244,994 B1 * 6/2001 Tilberis ..... A63B 21/0023 482/124
6,244,998 B1 * 6/2001 Hinds ..... A63B 21/0004 482/124
6,264,584 B1 * 7/2001 Bass ..... A63B 21/4009 482/54
6,443,876 B1 9/2002 Huang
6,454,679 B1 * 9/2002 Radow ..... A63B 22/0235 482/4
6,575,876 B1 * 6/2003 Phelps-McMillon ..... A63B 22/0235 482/51
6,676,569 B1 * 1/2004 Radow ..... A63B 22/0235 482/4
7,175,574 B2 * 2/2007 Carmel ..... A63B 21/0004 482/124
7,344,485 B1 * 3/2008 Simpson ..... A63B 21/0004 482/121
D613,352 S * 4/2010 Rangel ..... D21/662
7,744,512 B2 * 6/2010 Clarke ..... A63B 21/0004 482/124
8,043,197 B2 * 10/2011 Hetrick ..... A63B 21/0023 482/904
8,317,667 B1 * 11/2012 Thomas ..... A63B 21/0555 482/121
9,370,680 B1 * 6/2016 Macaulay ..... A63B 71/023
9,517,173 B1 * 12/2016 Langmacher ..... A61H 1/0218
9,616,277 B2 * 4/2017 Ushikubo ..... A63B 22/0015
2003/0004038 A1 * 1/2003 Wroclawsky ..... A63B 22/02 482/54
2005/0009669 A1 * 1/2005 Harris ..... A63B 21/4009 482/69
2010/0204014 A1 * 8/2010 Hoffman ..... A63B 21/055 482/8
2011/0082013 A1 * 4/2011 Bastian ..... A63B 22/0235 482/54
2011/0230314 A1 * 9/2011 Hoffman ..... A63B 21/4009 482/51
2011/0237399 A1 * 9/2011 Toback ..... A63B 5/16 482/8
2013/0244835 A1 * 9/2013 Thompson ..... A63B 21/062 482/8
2014/0005015 A1 * 1/2014 Hester ..... A63B 21/154 482/131
2015/0080187 A1 * 3/2015 Beane ..... A63B 69/0064 482/51
2015/0367171 A1 * 12/2015 Truong ..... A63B 23/0205 482/4
2016/0346596 A1 * 12/2016 Manzke ..... A63B 21/00069
2016/0346598 A1 * 12/2016 Manzke ..... A63B 22/02
2016/0354669 A1 * 12/2016 Rozenberg ..... A63B 71/0054

* cited by examiner

TREADMILL BELTS THAT ENHANCE A USERS COMFORT AND STABILITY

CROSS-REFERENCE TO RELATED APPLICATION

The present application claims priority from U.S. Provisional Patent Application Ser. No. 62/315,234, filed on Mar. 30, 2016, which is incorporated herein by reference in its entirety.

BACKGROUND OF THE INVENTION

Field of the Invention

The present patent application is related to treadmill exercise equipment, and is more specifically related to stability and comfort belts worn by individuals when using treadmills.

Description of the Related Art

Treadmills provide a convenient means for engaging in physical exercise. Most treadmills use a motorized, endless loop belt that moves as a user walks or runs on the belt. Typically, the belt moves toward the rear of the treadmill as the user walks or runs toward the front of the treadmill for simulating forward travel over a surface. The speed of the moving belt can be varied to change speeds. Treadmills also utilize variable inclined positions in order to simulate changes in the grade of the terrain.

Fitness experts and professionals have continually emphasized the importance of a full body workout to increase cardiovascular circulation. For example, cross-country ski machines enable the user to exercise his legs as well as arms and upper body movement to increase cardiovascular circulation. It is possible to walk on a treadmill with the arms swinging freely, however, this requires delicate balance.

Treadmills typically incorporate front or side railings or bars that provide support for the user to grip while walking or running. It is usually necessary to grip the railings or bars because it becomes difficult to maintain one's balance when walking or running over the belt.

Although conventional treadmills provide a vigorous workout, the need to hold onto the treadmill frame to maintain balance restricts both of the user's arms from movement. In most cases, after a 15 to 20 minute workout the user's arms are stiff or ache from holding onto the frame or front handle bars. In addition, poor circulation results since the user's arms are held in a steadfast position, especially when the treadmill is inclined.

There have been a number of advancements related to belts for use with treadmills. In spite of such advances, there remains a need for improved treadmill belts that provide comfort and stability for a treadmill user. There also remains a need for a treadmill belt that provides a snugger fit around a user's waist or mid-section, and that can be adjusted to fit the waist and mid-sections of users having various sizes. There also remains a need for treadmill belts having replaceable parts, interchangeable parts, and parts that can be washed and sanitized.

BRIEF SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

In one embodiment, a treadmill comfort belt is adapted to pass around a user's waist and be secured to the frame of the treadmill to provide users with an extra measure of security, stability and comfort while using the treadmill at different speeds and tilt angles. In one embodiment, the treadmill comfort belt is worn around a user's mid-section or waist while the user holds onto the treadmill frame or treadmill support handles. The belt is designed to give additional comfort and stability to the user by easing the strain on the arms and hands as the speed and/or tilt of the treadmill are increased.

In one embodiment, a treadmill comfort belt includes an elastic bungee having a central elastic section, a first elastic strap, and a second elastic strap. The first elastic strap is connected with a first end of the central elastic section and the second elastic strap is connected to a second end of the central elastic section. In one embodiment, the central elastic section, the first elastic strap, and the second elastic strap may be replaceable parts that may be swapped out and replaced if they wear out or are damaged. In one embodiment, the first and second elastic straps may be interchangeable whereby an elastic strap can be used as either a first elastic strap or a second elastic strap.

In one embodiment, the treadmill comfort belt includes an abrasion protection sleeve that overlies the central elastic section of the belt. In one embodiment, the treadmill comfort belt includes a foam cushioning tube that overlies the abrasion protection sleeve to provide cushioning for a user's back. In one embodiment, the foam cushioning tube has an elongated conduit extending therethrough and the abrasion protection sleeve and the central elastic section of the belt are disposed inside the elongated conduit of the foam tube. The abrasion protection sleeve enables the central elastic section to stretch and move relative to the abrasion protection sleeve and insulates the central elastic section from damaging the foam tubing as the central elastic section stretches and moves during use of the belt.

In one embodiment, the treadmill comfort belt desirably has a moisture and odor barrier that is wrapped over the outer surface of the foam tube. In one embodiment, the moisture and odor barrier blocks sweat and/or moisture from entering the pores of the foam tube.

In one embodiment, the treadmill comfort belt also desirably includes a protective outer sleeve, such as a spandex cover, that is secured over the foam tubing and the moisture and odor barrier. The protective outer sleeve may have fasteners provided at the ends thereof for securing the protective outer sleeve in place over the foam tube and the abrasion protection sleeve overlying the central section of the belt.

In one embodiment, the treadmill comfort belt has securing elements for securing the belt to the frame of a treadmill. In one embodiment, the securing elements include a first S-shaped hook adapted to be secured to the free end of the first elastic strap and a second S-shaped hook adapted to be secured to the free end of the second elastic strap.

In one embodiment, the treadmill comfort belt includes a crossover tension ring having a hinge and two free ends that may be latched or secured together via a latch structure. In one embodiment, after the belt has been positioned around a user's waist and secured to the treadmill, the crossover tension ring may be used to hold the first and second elastic straps together in a crossed over configuration to remove any slack remaining in the belt.

In another embodiment, a treadmill comfort belt includes a strap having a first end portion and a second end portion. Each of the first end portion and the second end portion has a securing member. A lumbar support portion is disposed between the first end portion and the second end portion. A compressible sleeve is disposed over the lumbar support portion. A collar is slidingly disposed over the first end portion and the second end portion. The collar is adapted to slide between the securing members and the sleeve.

When using the belt disclosed herein, a user can hold onto the frame for longer periods of time at higher speeds and greater tilt settings. As a result, a user can burn more calories and achieve a greater degree of physical fitness. A treadmill workout no longer has to be a struggle whereby a user suffers from muscle fatigue in the arms and hands.

These and other exemplary embodiments of the present invention will be described in more detail below.

BRIEF DESCRIPTION OF THE DRAWINGS

The accompanying drawings, which are incorporated herein and constitute part of this specification, illustrate exemplary embodiments of the invention, and, together with the general description given above and the detailed description given below, serve to explain the features of the invention. In the drawings.

DETAILED DESCRIPTION

Figure 1A:
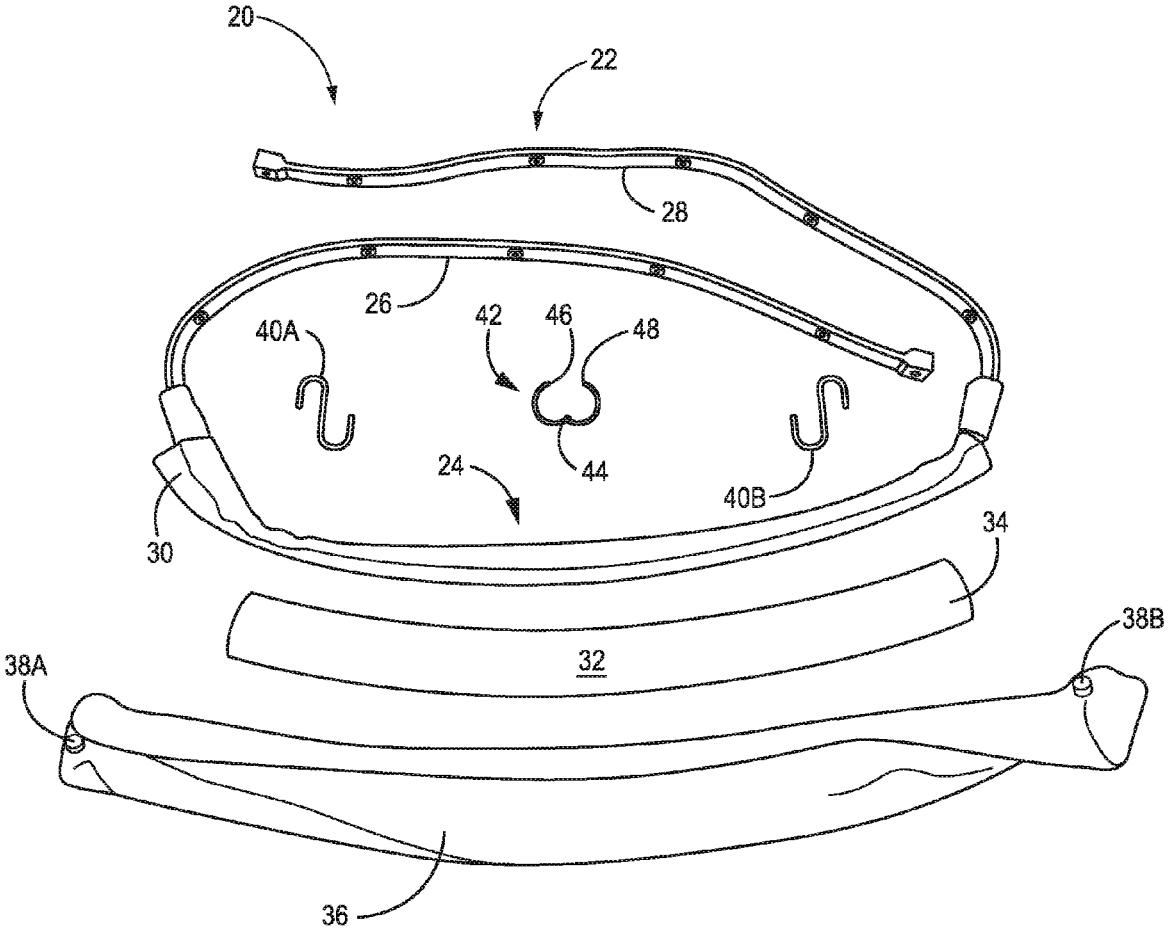
FIGS. 1A and 1B show an exploded view of a treadmill comfort belt including an elastic bungee having a first elastic belt and a second elastic belt, an abrasion protection sleeve, a foam tube, an outer sleeve, a pair of S-shaped hooks, and a crossover tension ring, in accordance with one embodiment of the present invention.

In the drawings, like numerals indicate like elements throughout. Certain terminology is used herein for convenience only and is not to be taken as a limitation on the present invention. The terminology includes the words specifically mentioned, derivatives thereof and words of similar import. The embodiments illustrated below are not intended to be exhaustive or to limit the invention to the precise form disclosed. These embodiments are chosen and described to best explain the principle of the invention and its application and practical use and to enable others skilled in the art to best utilize the invention.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation."

As used in this application, the word "exemplary" is used herein to mean serving as an example, instance, or illustration. Any aspect or design described herein as "exemplary" is not necessarily to be construed as preferred or advantageous over other aspects or designs. Rather, use of the word exemplary is intended to present concepts in a concrete fashion.

Additionally, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

Unless explicitly stated otherwise, each numerical value and range should be interpreted as being approximate as if the word "about" or "approximately" preceded the value of the value or range.

The use of figure numbers and/or figure reference labels in the claims is intended to identify one or more possible embodiments of the claimed subject matter in order to facilitate the interpretation of the claims. Such use is not to be construed as necessarily limiting the scope of those claims to the embodiments shown in the corresponding figures.

It should be understood that the steps of the exemplary methods set forth herein are not necessarily required to be performed in the order described, and the order of the steps of such methods should be understood to be merely exemplary. Likewise, additional steps may be included in such methods, and certain steps may be omitted or combined, in methods consistent with various embodiments of the present invention.

Although the elements in the following method claims, if any, are recited in a particular sequence with corresponding labeling, unless the claim recitations otherwise imply a particular sequence for implementing some or all of those elements, those elements are not necessarily intended to be limited to being implemented in that particular sequence.

Figure 1B:
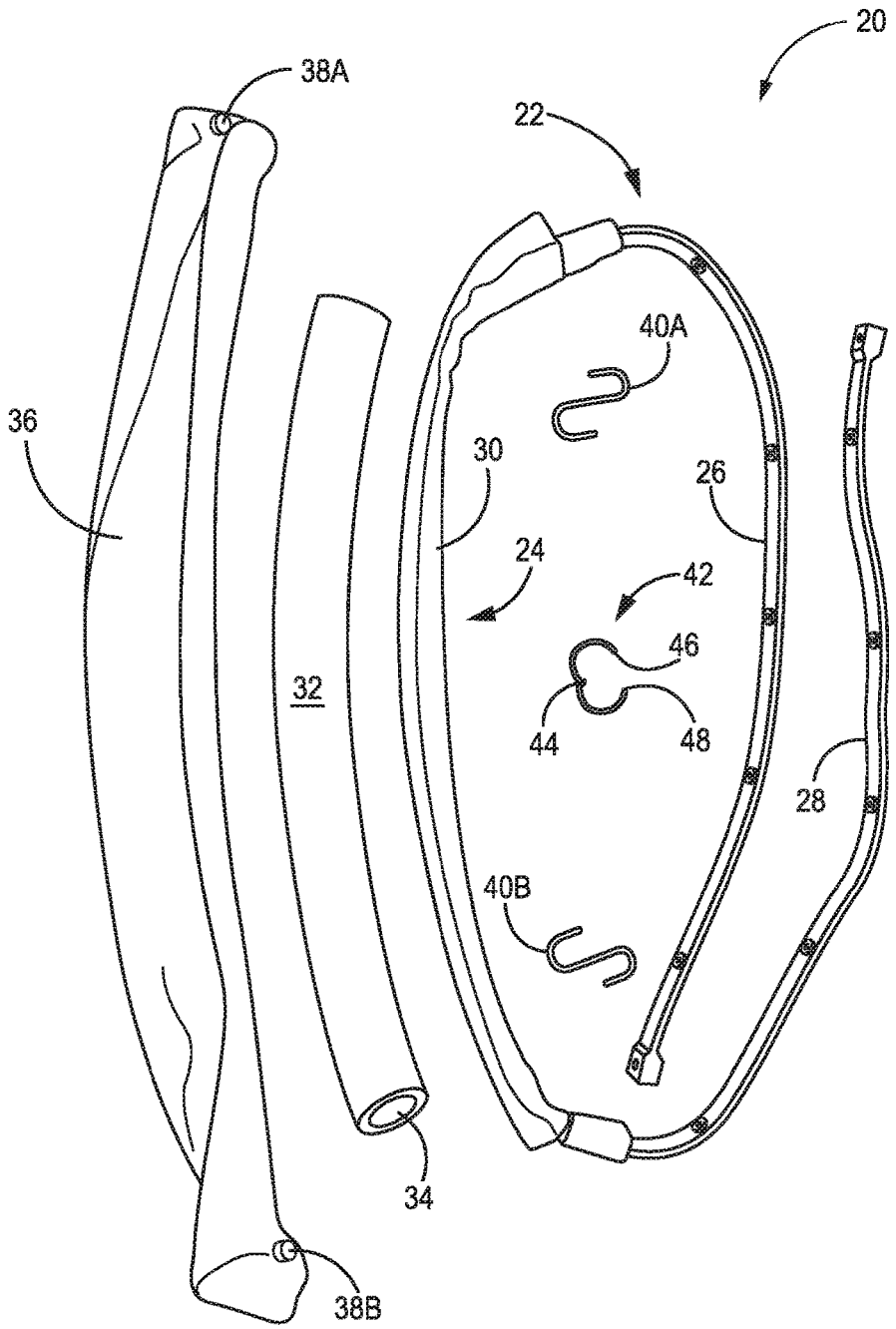

Referring to FIGS. 1A and 1B, in one embodiment, a treadmill comfort belt 20 includes an elastic bungee 22 having a central elastic section 24, a first elastic strap 26, and a second elastic strap 28. The first elastic strap 26 is connected with a first end of the central elastic section 24 and the second elastic strap 28 is connected to a second end of the central elastic section 24. In one embodiment, any of the central elastic section 24, the first elastic strap 26, and the second elastic strap 28 may be replaceable parts that may be disassembled and replaced if they wear out or are damaged. For example, the first elastic strap 26 may become worn and be replaced by a new first elastic strap that is attached to the first end of the central elastic section 24. In one embodiment, the first and second elastic straps may be interchangeable whereby an elastic strap can be used as either a first elastic strap or a second elastic strap.

In one embodiment, the treadmill comfort belt 20 includes an abrasion protection sleeve 30 that overlies the central elastic section 24 of the belt 20. In one embodiment, the treadmill comfort belt 20 includes a foam cushioning tube 32 that overlies the abrasion protection sleeve 30. In one embodiment, the foam cushioning tube 32 has an elongated conduit extending therethrough and the abrasion protection sleeve 30 and the central elastic section 24 of the belt 20 are disposed inside the elongated conduit of the foam tube. In one embodiment, the foam tube is about 24 inches long and has an outer diameter of about 2 inches. In one embodiment, the foam tube is an insulating tube used to cover water pipes.

In one embodiment, the abrasion protection sleeve 30 enables the central elastic section 24 to stretch and move relative to the abrasion protection sleeve. The abrasion protection sleeve 30 prevents the central elastic section 24 from damaging the foam tubing 32 as the central elastic section 24 stretches during use.

In one embodiment, the abrasion protection sleeve is longer than the foam tube. In one embodiment, the abrasion protection sleeve is about 28 inches long and extends about two inches beyond either end of the of the foam tubing. The abrasion protection sleeve can be made of any suitable material that has a low coefficient of friction to allow the elastic bungee to move freely within the abrasion protection sleeve as the bungee stretches and relaxes, while protecting the foam tubing from abrasion.

In one embodiment, the treadmill comfort belt 20 desirably has a moisture and odor barrier 34 that is wrapped over the outer surface of the foam tube 32. In one embodiment, the moisture and odor barrier 34 blocks sweat and/or moisture from entering the pores of the foam tube 32. In one embodiment, the moisture and odor barrier 34 may be a plastic wrap such as Saran Wrap or a dryer sheet such as Cling Plus. In one embodiment, the moisture and odor barrier may be an integral part of the foam tubing or may be applied as a wrap.

In one embodiment, the treadmill comfort belt 20 also desirably includes a protective outer sleeve 36, such as a spandex cover, that is secured over the foam tubing 32 and the moisture and odor barrier 34. The protective outer sleeve 36 may have fasteners 38A, 38B such as snap buttons or draw strings provided at the ends thereof for securing the protective outer sleeve 36 in place over the foam tube 32 and the abrasion protection sleeve 30 overlying the central section 24 of the belt 20. The outer sleeve 36 is washable and may be removed from the belt for cleaning. In one embodiment, the protective outer cover may be made of assorted colors.

In one embodiment, the treadmill comfort belt 20 has securing elements for securing the belt to the frame of a treadmill. In one embodiment, the treadmill comfort belt includes a first S-shaped hook 40A adapted to be secured to the free end of the first elastic strap 26 and a second S-shaped hook 40B adapted to be secured to the free end of the second elastic strap 28.

In one embodiment, the treadmill comfort belt 20 includes a crossover tension ring 42 having a hinge 44 and two free ends 46, 48 that may be latched or secured together via a closing structure (e.g., a latch) as will be described in more detail below.

Figure 2:
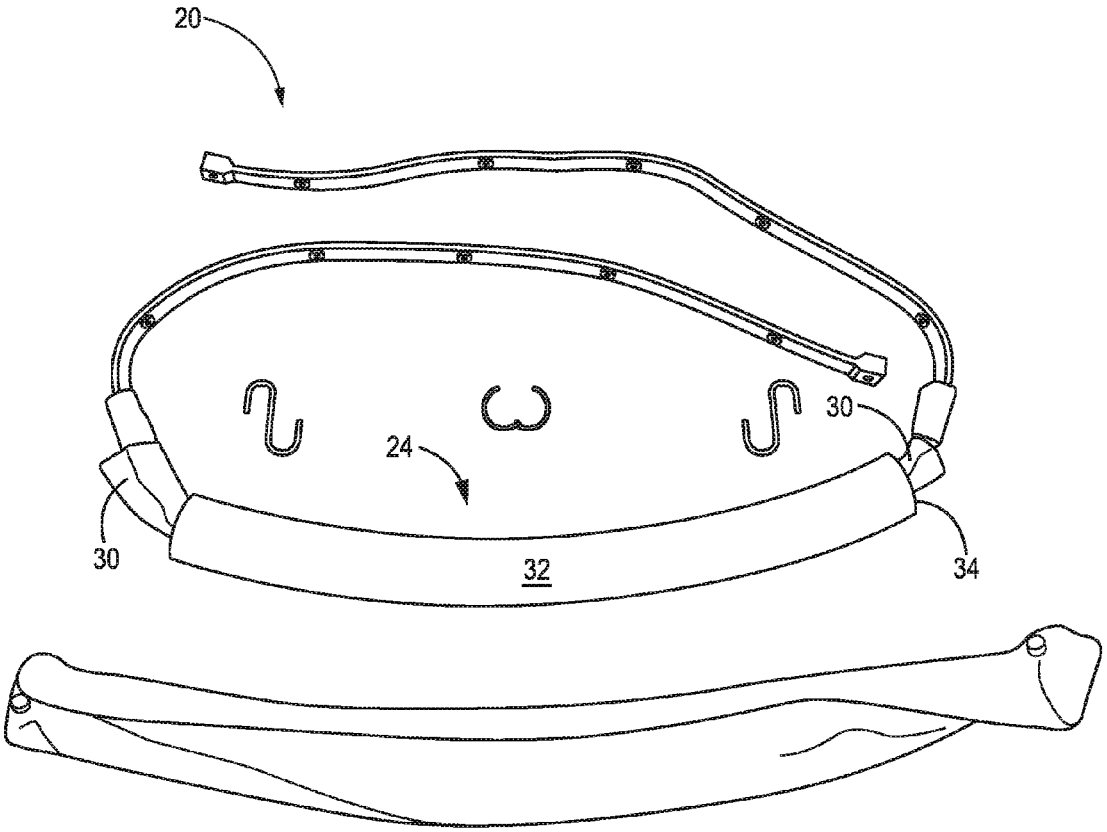
FIG. 2 shows the foam tube of FIG. 1 assembled over the abrasion protection sleeve of FIG. 1.

Referring to FIG. 2, in one embodiment, the foam tubing 32 having the moisture and odor barrier 34 is assembled over the abrasion protection sleeve 30 covering the central elastic section 24 (FIG. 1A) of the bungee 22 of the comfort belt 20. As the central elastic section 24 of the bungee 22 stretches and moves during use, the abrasion protection sleeve 30 provides an insulating layer that prevents the stretching and moving central elastic section 24 from rubbing against the foam tube 32, which could damage the foam tube due to friction forces.

Figure 3A:
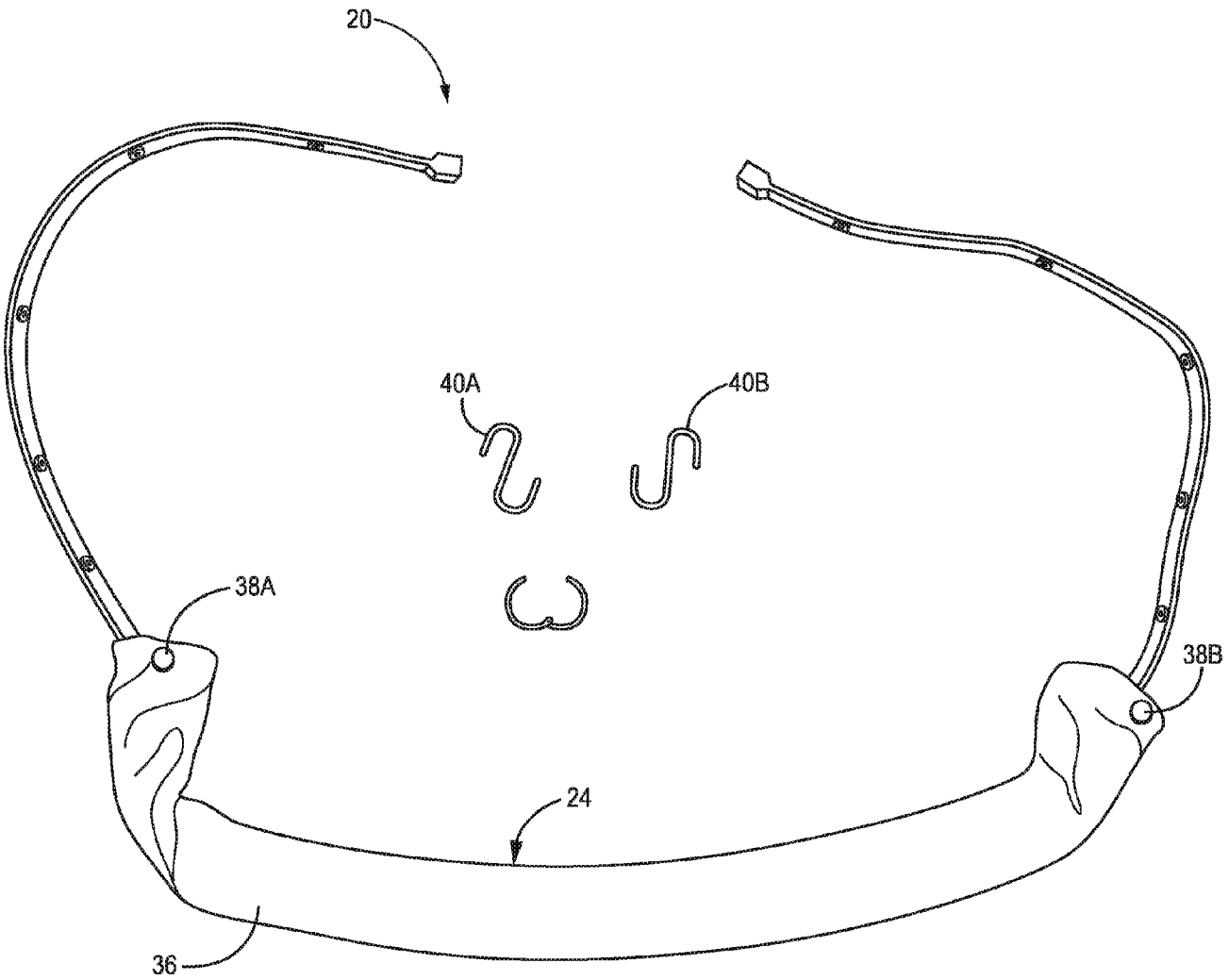
FIG. 3A shows the outer sleeve of FIG. 1 secured over the subassembly shown in FIG. 2.

Referring to FIG. 3A, in one embodiment, the outer protective sleeve 36 may be assembled over the foam tubing 32 (FIG. 2) that is disposed over the central elastic section 24 of the treadmill comfort belt 20. The fasteners 38A, 38B at the respective ends of the outer protective sleeve 36 are utilized to secure the outer protective sleeve 36 in place and over the central elastic section 24 of the comfort belt 20.

Figure 3B:
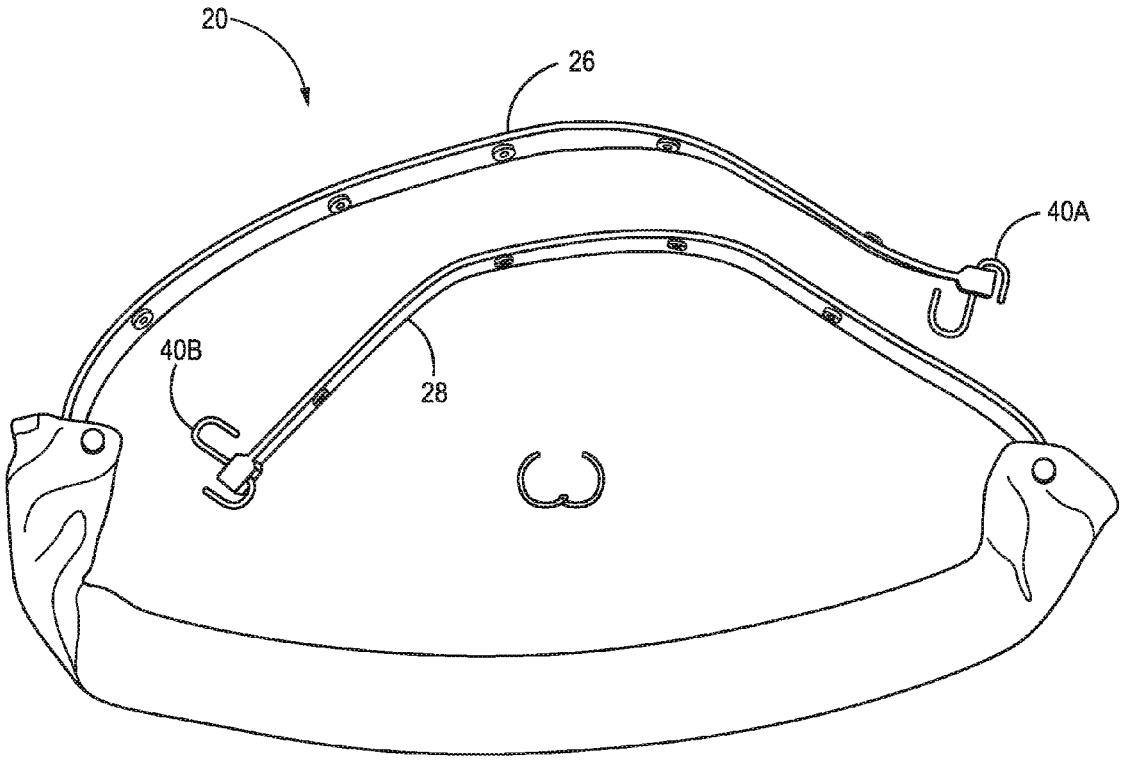
FIG. 3B shows the S-shaped hooks of FIG. 1 secured to the free ends of the first and second elastic belts.

Referring to FIGS. 3A and 3B, in one embodiment, the first S-shaped hook 40A is secured to the free end of the first elastic strap 26. Similarly, the second S-shaped hook 40B is secured to the free end of the second elastic strap 28. As will be described in more detail herein, the first and second S-shaped hooks 40A, 40B are used to secure the first and second elastic straps 26, 28 to the frame of an exercise machine such as a treadmill exercise machine.

Figure 4A:
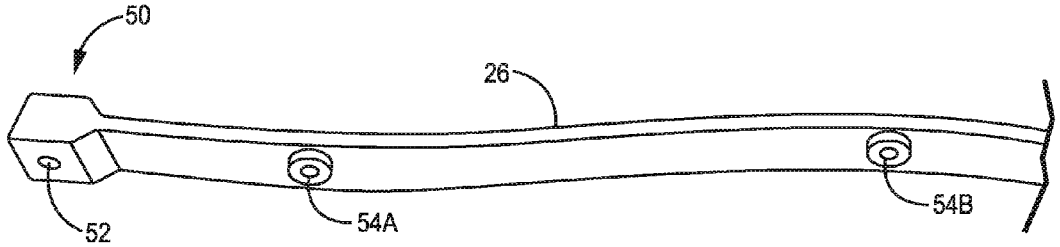
FIGS. 4A and 4B show a method of securing one of the S-shaped hooks and the crossover tension ring of FIG. 1 secured to the first elastic belt.

Referring to FIG. 4A, in one embodiment, the first elastic strap 26 includes a free end 50 having a free end opening 52 extending therethrough. The first elastic strap 26 also includes a series of reinforced openings 54A, 54B, etc. that are spaced from one another along the length of the first elastic strap 26.

Figure 4B:
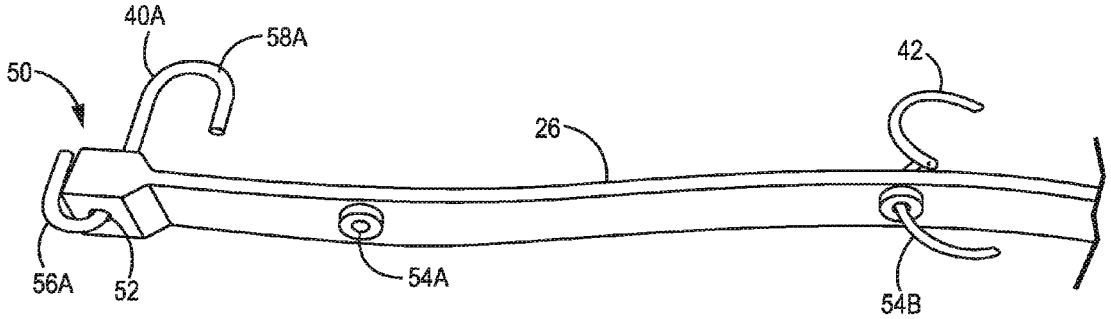

Referring to FIG. 4B, in one embodiment, a smaller curved section 56A of the first S-shaped hook 40A is passed through the free end opening 52 at the free end 50 of the first elastic strap 26. A larger curved section 58A of the first S-shaped hook 40A remains free for being passed through one of the reinforced openings 54A, 54B, etc. spaced from one another along the length of the first elastic strap 26. In one embodiment, the reinforced openings on the first and second elastic straps are spaced about 2-4 inches apart from one another and, alternatively, about 4 inches apart from one another. In one embodiment, reinforced openings are only provided on the first and second elastic straps and the central elastic section of the bungee has no opening or holes formed therein.

In FIG. 4B, the crossover tension ring 42 is passed through the second reinforced opening 54B of the first elastic belt 26. The crossover tension ring 42 is used to hold the first and second elastic straps together in a crossed over configuration as will be described in more detail herein. In one embodiment, the crossover tension ring is made of a durable metal such as stainless steel or aluminum and has a diameter of about one inch. In one embodiment, the crossover tension ring is hinged and "latchable" to facilitate adjustment of the first and second elastic straps relative to one another.

Figure 5A:
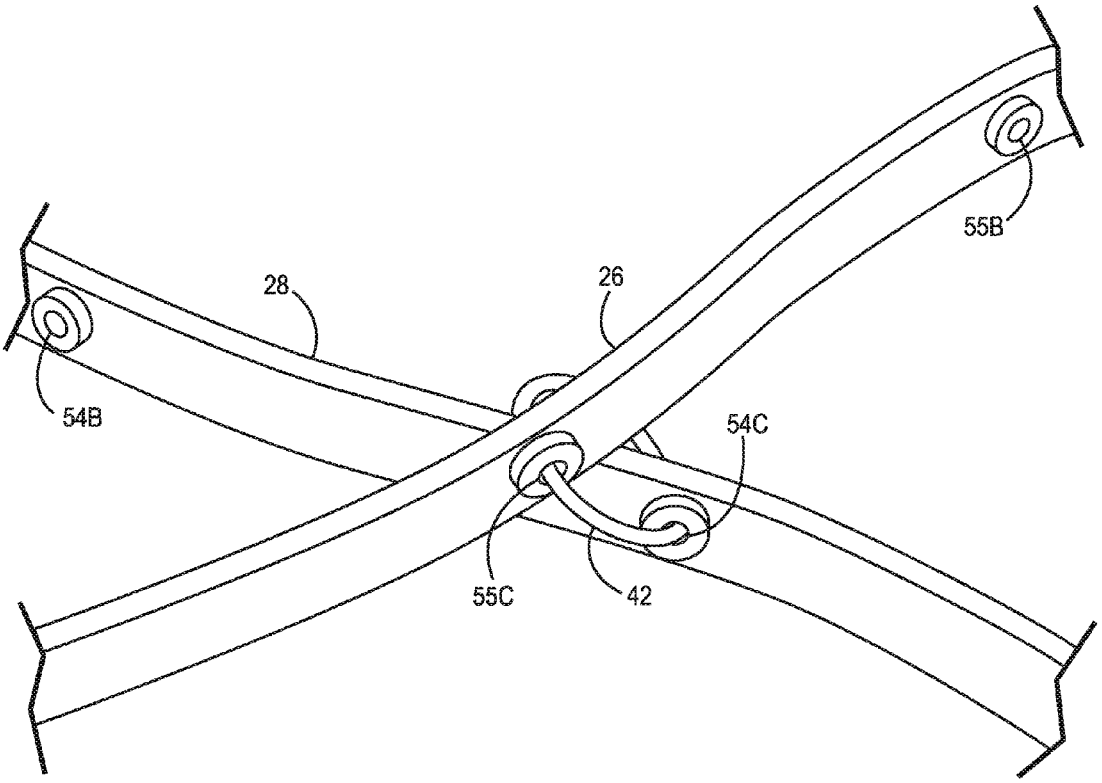
FIGS. 5A and 5B show the crossover tension ring holding the first and second elastic belts of FIG. 1 in a crossed configuration.
Figure 5B:
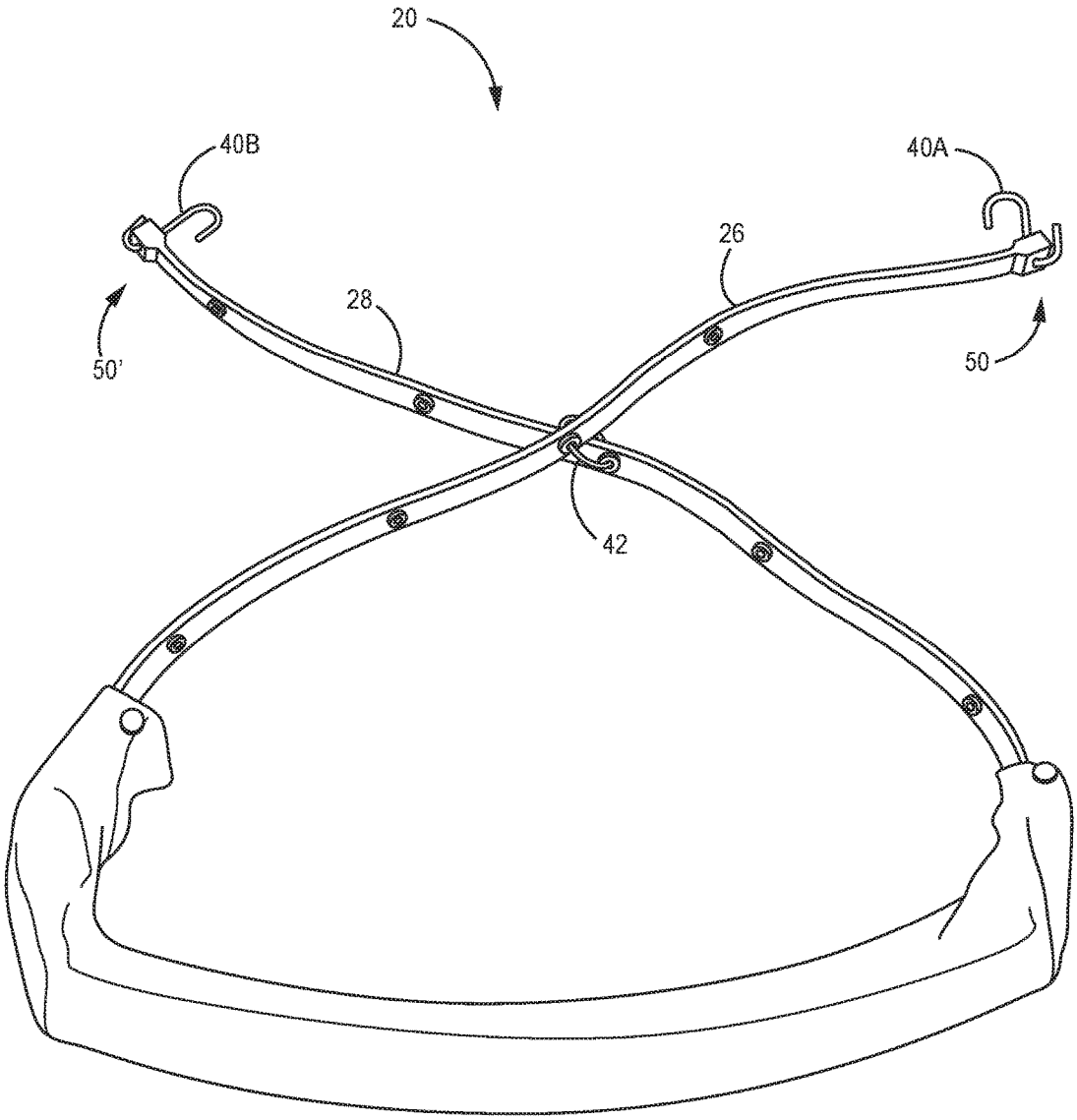

Referring to FIGS. 5A and 5B, in one embodiment, the first and second elastic straps 26, 28 are crossed over one another and secured together in the crossed over configuration using the crossover tension ring 42. In the embodiment shown in FIG. 5A, the first elastic strap 26 includes first reinforced opening 54A and second reinforced opening 54B. The second elastic strap 28 includes second reinforced opening 55B and third reinforced opening 55C. After the first and second elastic straps 26, 28 are crossed over one another to remove slack from the treadmill comfort belt, the free ends of the crossover tension ring 42 are passed through the aligned reinforced openings 54B, 55B of the respective first and second elastic straps 26, 28 for maintaining the first and second elastic straps 26, 28 in the crossed over configuration.

FIG. 5B shows the treadmill comfort belt 20 with first and second elastic straps 26, 28 in a crossed over configuration and maintained in the crossed over configuration by the crossover tension ring 42. In FIG. 5B, the first S-shaped hook 40A is secured to the free end 50 of the first elastic strap 26 and the second S-shaped hook 40B is secured to the free end 50' of the second elastic strap 28.

Although the present invention is not limited by any particular theory of operation, it is believed that using the crossover tension ring 42 enables excess slack in the belt to be removed from the treadmill comfort belt 20 to hold the belt more snugly around a user's waist. A loose belt around a user's waist may result in instability or an unsafe condition. In one embodiment, if the belt 20 is too loose around a user's waist, the location of the crossover tension ring 42 may be moved closer to the user's anterior mid-section to adjust the amount of slack remaining in the treadmill comfort belt 20.

Figure 6:
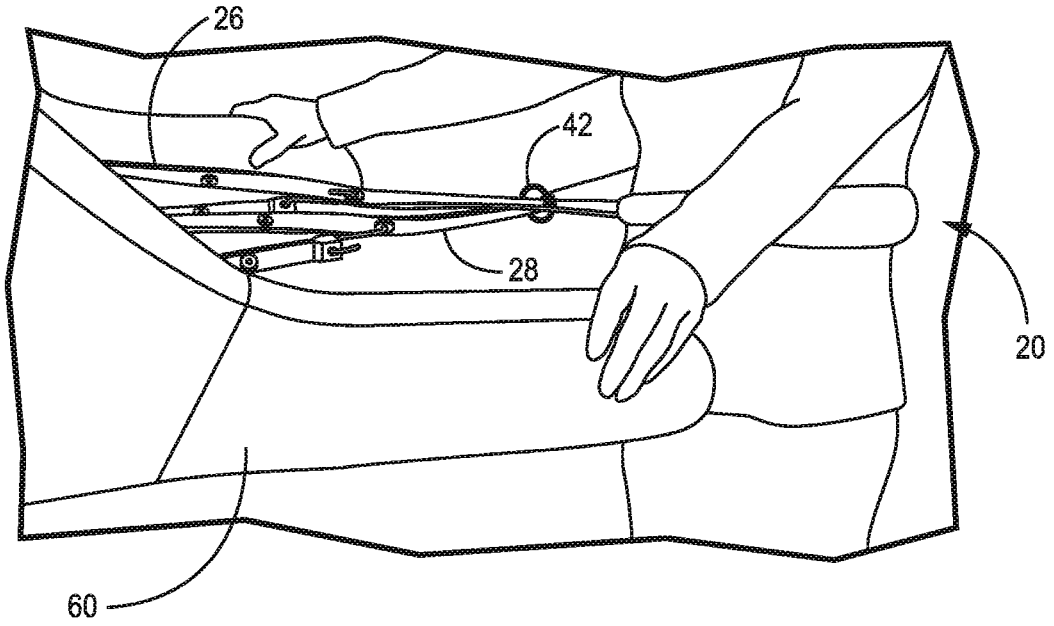
FIG. 6 shows a treadmill comfort belt secured around the waist of a user operating a treadmill, in accordance with one embodiment of the present invention.

Referring to FIG. 6, in one embodiment, the treadmill comfort belt 20 is positioned around a user's waist and secured to a frame of a treadmill 60. The first and second elastic belts 26, 28 are crossed over one another and held in the crossed over configuration by the crossover tension ring 42 that removes excess slack from the treadmill comfort belt 20 so the belt is snug around the user's waist.

Figure 7:
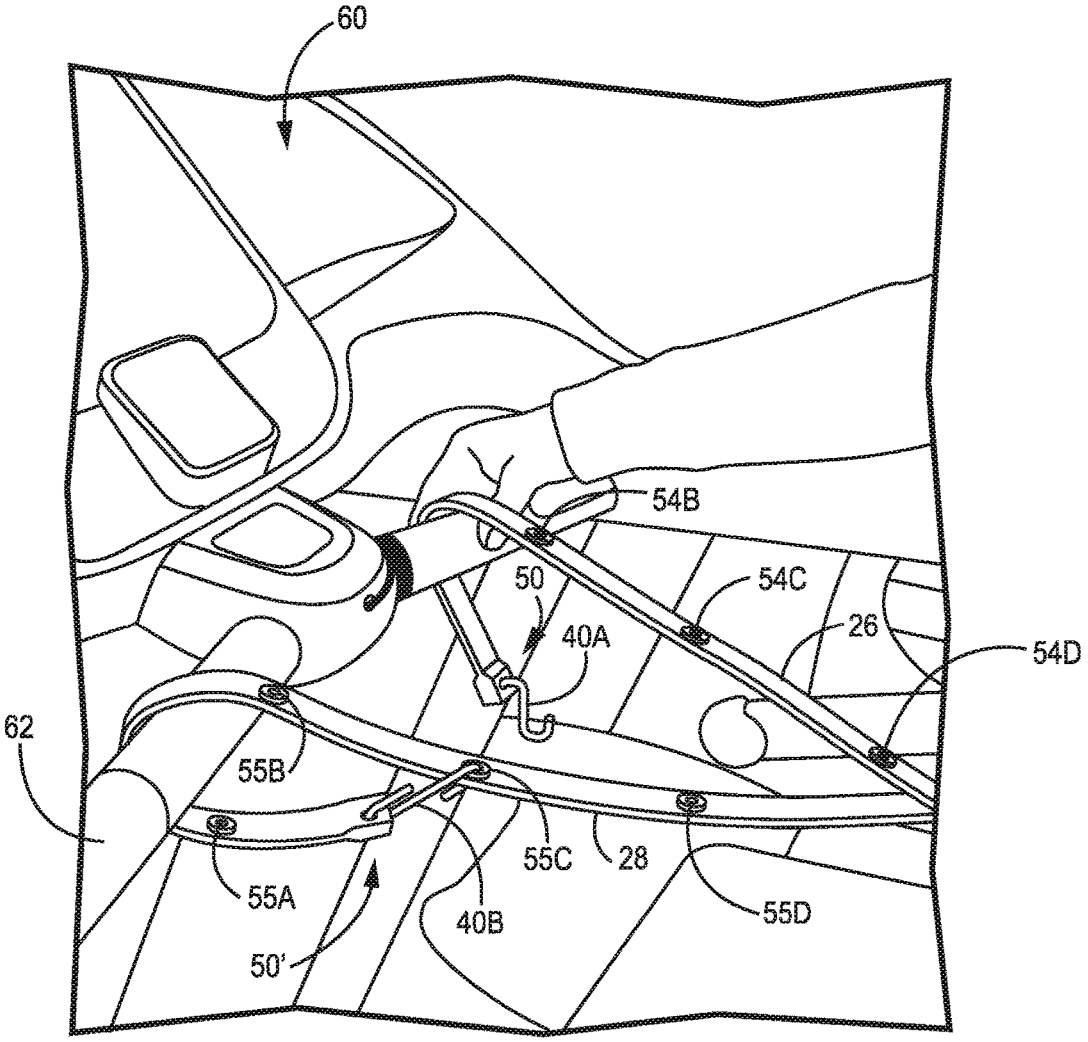
FIGS. 7 and 8A-8C show a method of securing a treadmill comfort belt to a treadmill, in accordance with one embodiment of the present invention.

Referring to FIG. 7, in one embodiment, in order to secure the treadmill comfort belt to the treadmill 60, the second elastic strap 28 is secured to a stabilizing bar 62 of the frame of the treadmill 60 by passing the free end 50' having the second S-shaped hook 40B over the top of the stabilizing bar 62 and looping the free end 50' back toward one of the reinforced openings 55A-55D provided along the length of the second elastic strap 28. In the embodiment shown in FIG. 7, the larger curved section of the second S-shaped hook 40B is passed through the third reinforced opening 55C provided on the second elastic strap 28.

In one embodiment, the first elastic strap 26 is crossed over the top of the second elastic strap 28. The free end 50 of the first elastic strap 26 is passed over the top of the stabilizing bar 62 and looped back toward the reinforced openings 54A-54D provided along the length of the first elastic belt 26.

Figure 8A:
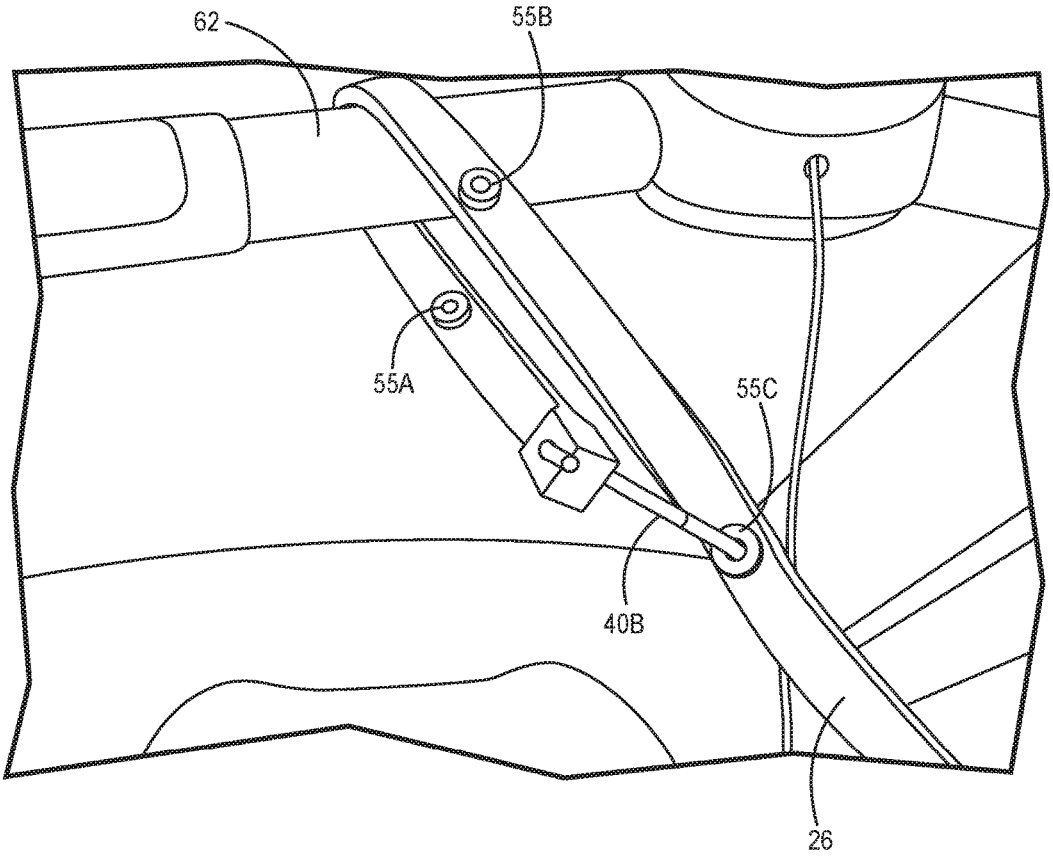

Referring to FIG. 8A, after the first elastic belt 26 has been looped over the stabilizing bar 62, the larger curved section of the first S-shaped hook 40A is passed through the third reinforced opening 54C of the first elastic belt 26 for securing the first elastic belt to the frame of the treadmill.

Figure 8B:
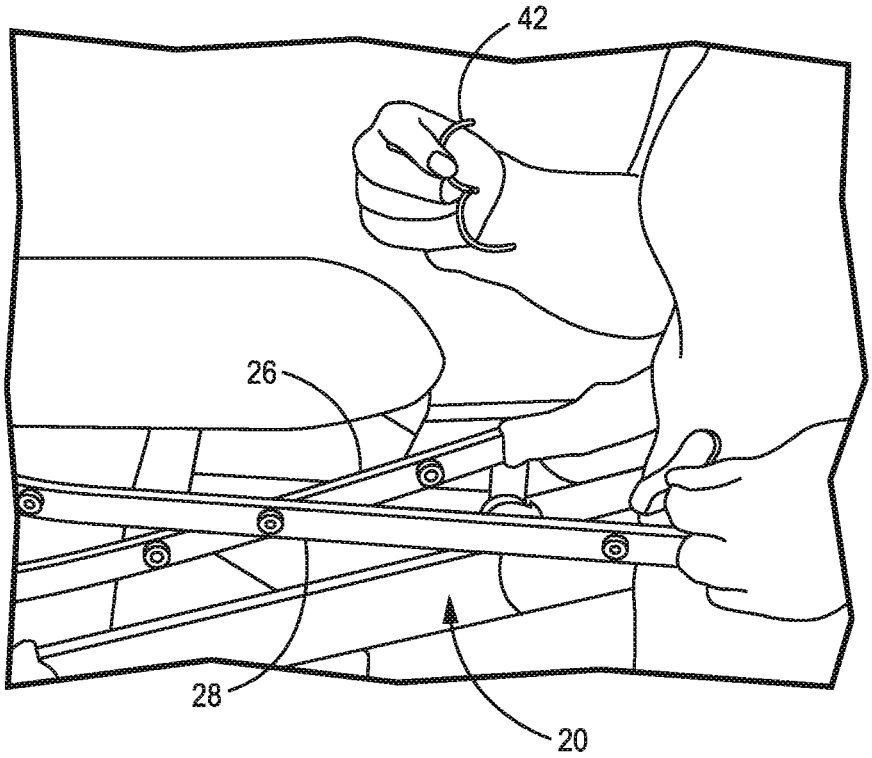

Referring to FIG. 8B, the crossover tension ring 42 may then be utilized to remove any slack remaining in the treadmill comfort belt 20. As described herein, the crossover tension ring 42 desirably holds the first and second elastic belts 26, 28 in a crossover configuration for removing any excess slack in the belt 20 and providing a snugger fit of the treadmill comfort belt around a user's waist.

Figure 8C:
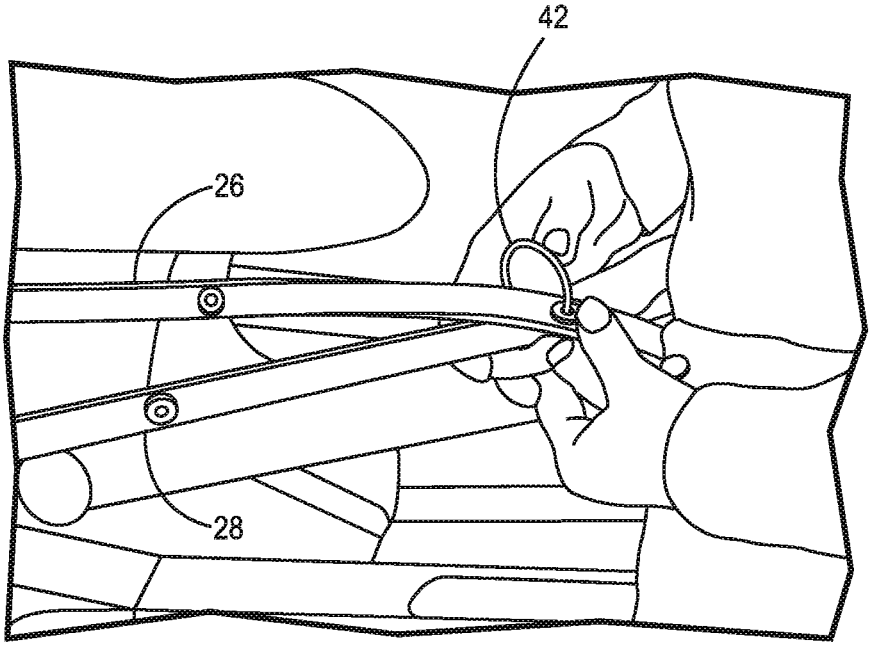

Referring to FIG. 8C, in one embodiment, the free ends of the crossover tension ring 42 are passed through aligned reinforced openings provided on the respective first and second elastic straps 26, 28.

Figure 9A:
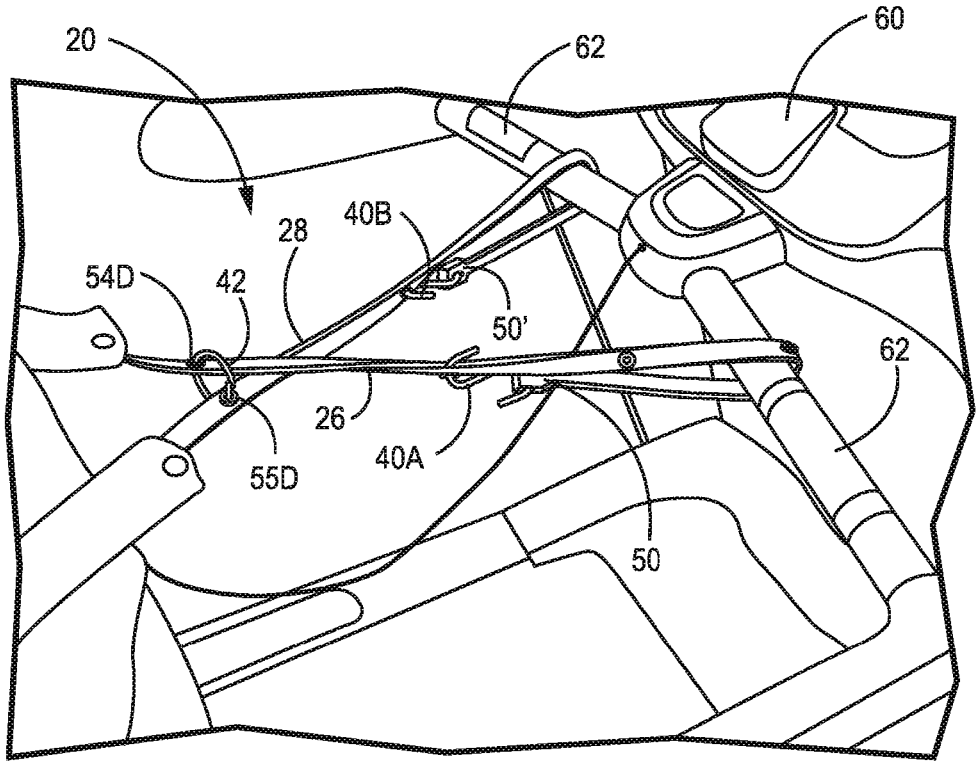
FIGS. 9A-9B show a treadmill comfort belt secured around the waist of a user operating a treadmill, in accordance with one embodiment of the present invention.
Figure 9B:
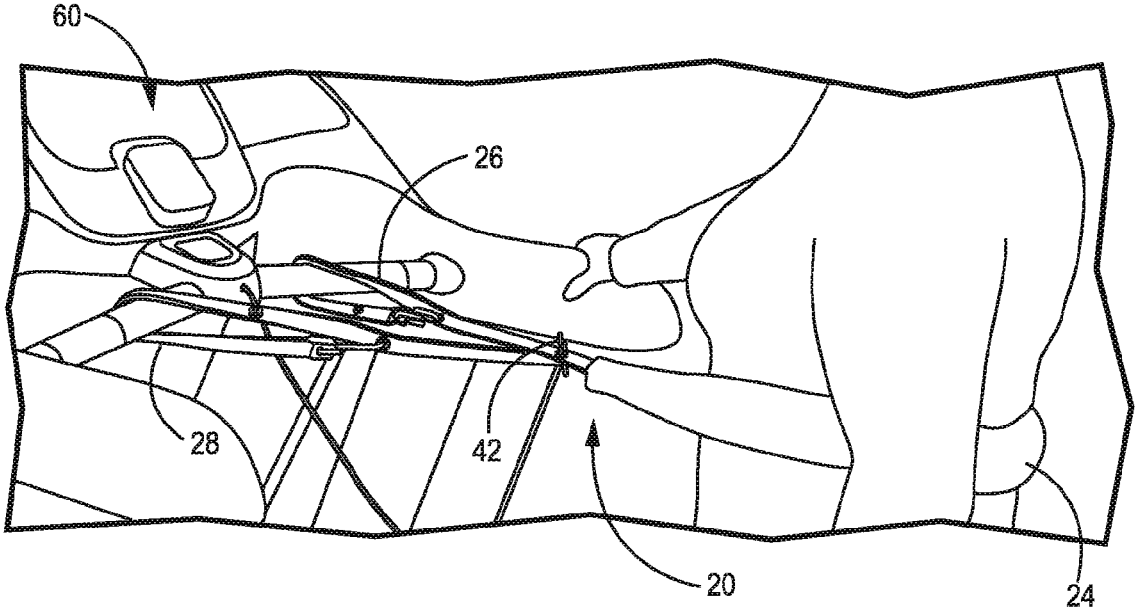

Referring to FIGS. 9A and 9B, in one embodiment, the free end 50 of the first elastic strap 26 is looped over the stabilizing bar 62 of the treadmill 60. The first S-shaped hook 40A is passed through the free end opening 52 (FIG. 4A) hole at the free end 50 of the first elastic strap 26 and one of the reinforced openings spaced along the length of the first elastic strap 26. The second elastic belt 28 is crossed over the first elastic belt 26. The free end 50' of the second elastic belt 26 is passed over the stabilizing bar 62 of the treadmill 60 and looped back toward one of the reinforced openings on the second elastic belt 28. The second S-shaped hook 40B secures the free end 50' of the second elastic strap 28 to one of the reinforced openings spaced along the length of the second elastic strap 28. In one embodiment, the free ends of the crossover tension ring 42 are passed through a reinforced opening 54D on the first elastic strap 26 and a reinforced opening 55D on the second elastic strap 28 for maintaining the first and second elastic straps in the crossed over configuration of FIG. 9A and removing any excess slack remaining in the treadmill comfort belt 20. As shown in FIGS. 9A and 9B, the crossover tension ring 42 holds the central elastic section 24 of the treadmill comfort belt 20 snuggly around the user's waist and sides for providing additional stability as the user walks and/or runs on the treadmill 60.

Figure 10A:
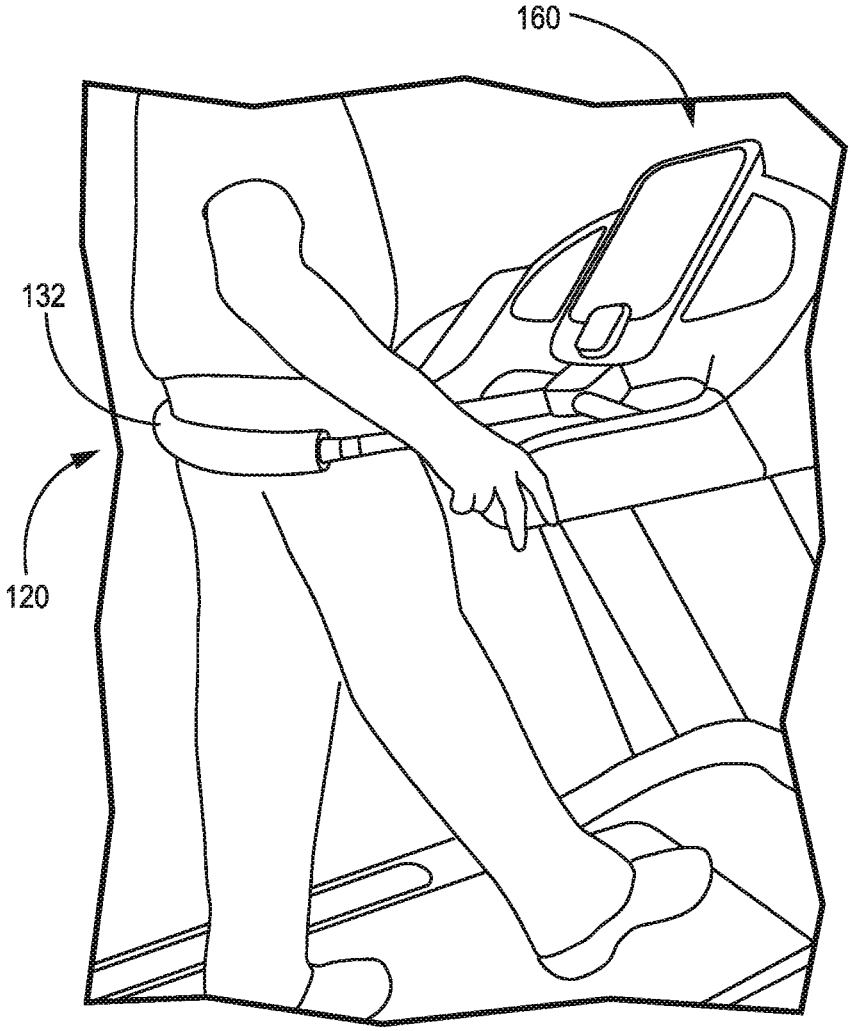
FIGS. 10A-10C show a treadmill comfort belt secured around the waist of a user operating a treadmill, in accordance with another embodiment of the present invention.

Referring to FIG. 10A, in one embodiment, a treadmill comfort belt 120 is utilized to support a user as the user walks and/or runs on a treadmill 160 that is tilted at an angle. The treadmill comfort belt 120 can wrap around the back of the user's waist for supporting the user on the tilted treadmill. As a result, the user does not have to exert an excessive amount of energy to stay in position on the tilted treadmill.

Figure 10B:
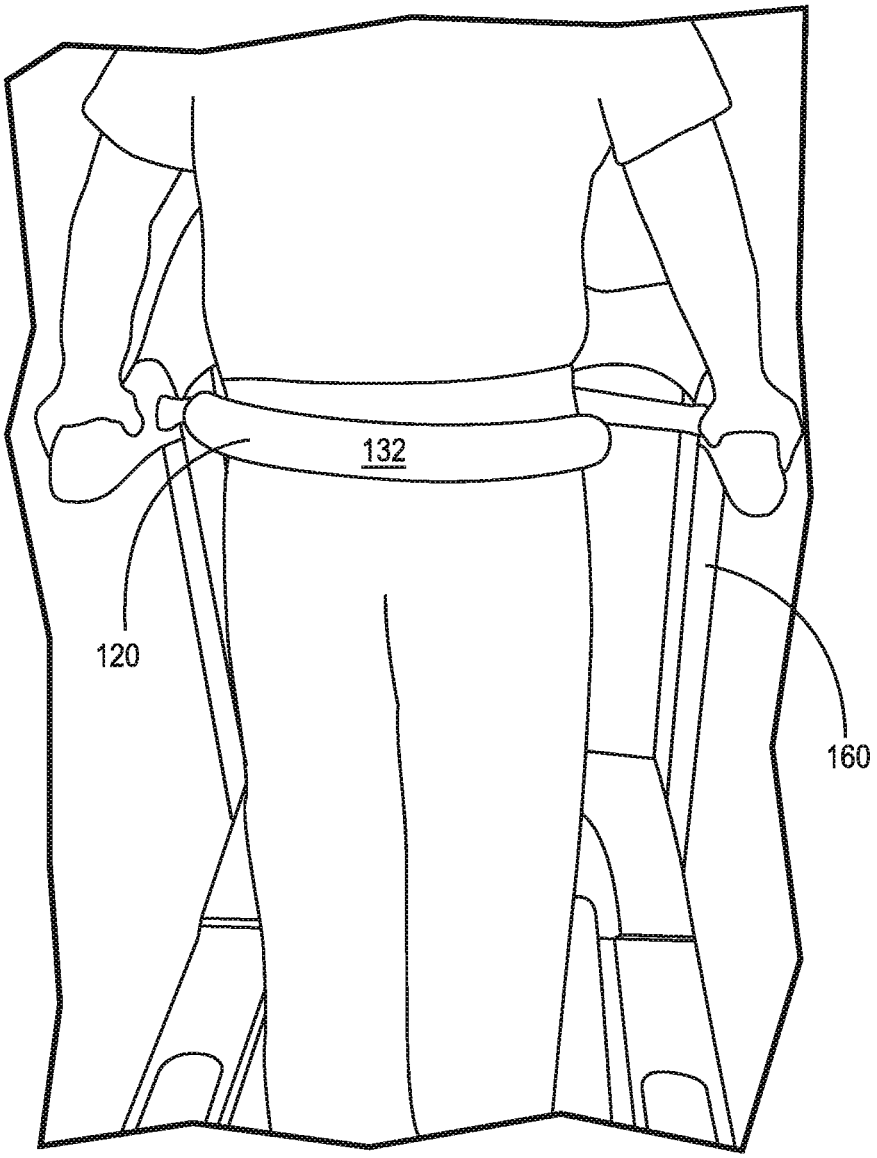
Figure 10C:
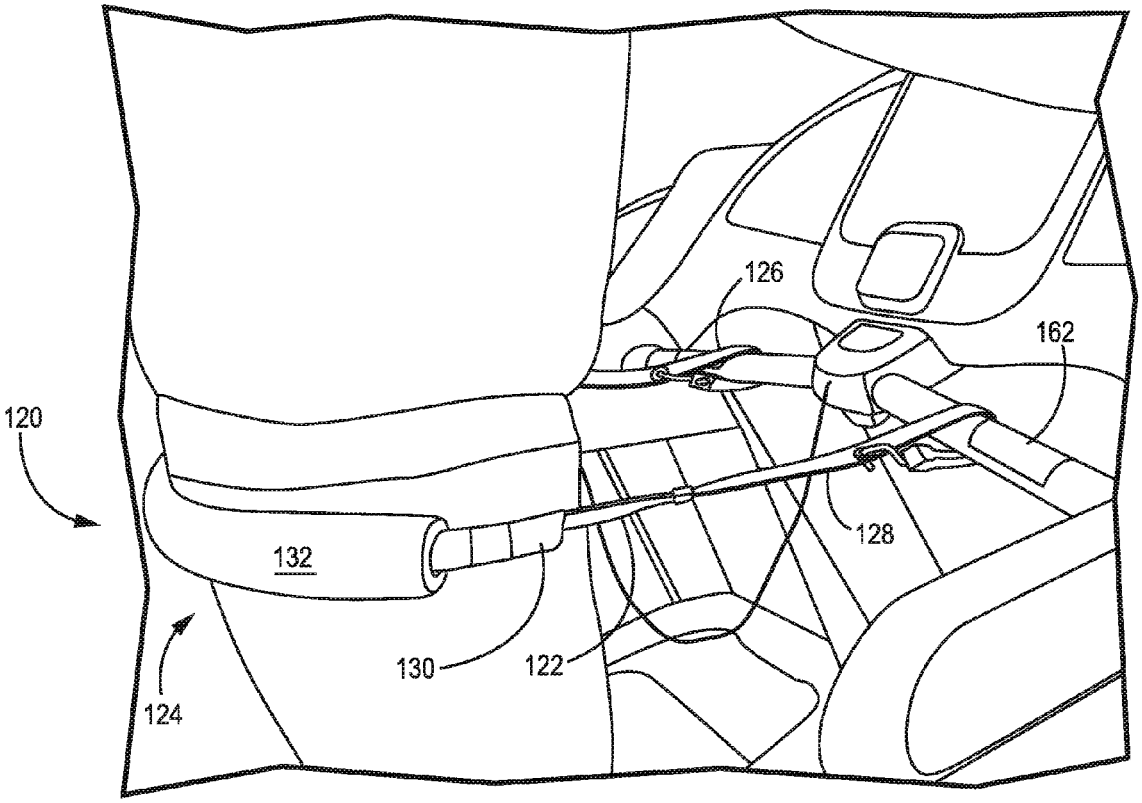

Referring to FIGS. 10A-10C, in one embodiment, the treadmill comfort belt 120 includes an elastic bungee 122 having a central elastic section 124 covered by an abrasion protection sleeve 130 and a foam tube 132 that covers the abrasion protection sleeve 130. The elastic bungee 122 includes a first elastic strap 126 and a second elastic strap 128, each having respective S-shaped hooks connected to free ends thereof as described in more detail above. The free ends of the first and second elastic straps 126, 128 are wrapped around a stabilizing bar 162 and the S-shaped hooks are passed through reinforced openings provided on the respective first and second elastic straps 126, 128. The foam tube 132 can cover the user's back side and provides cushioning for comfort. The abrasion protection sleeve 130 provides an insulator between the stretching and moving central elastic section 124 of the elastic bungee 126 and the foam tube 132 so that the foam tube is not worn due to friction forces between the stretching and moving central elastic section 124 and the foam tube 132.

In the particular embodiment shown in FIGS. 10A-10C, the first and second elastic straps 126, 128 are not crossed over one another prior to being secured around the support handle 162. In other embodiments, however, the first and second elastic straps 126, 128 may be crossed over one another and held together using the crossover tension ring 42 (FIG. 5A), shown and described herein.

Figure 11:
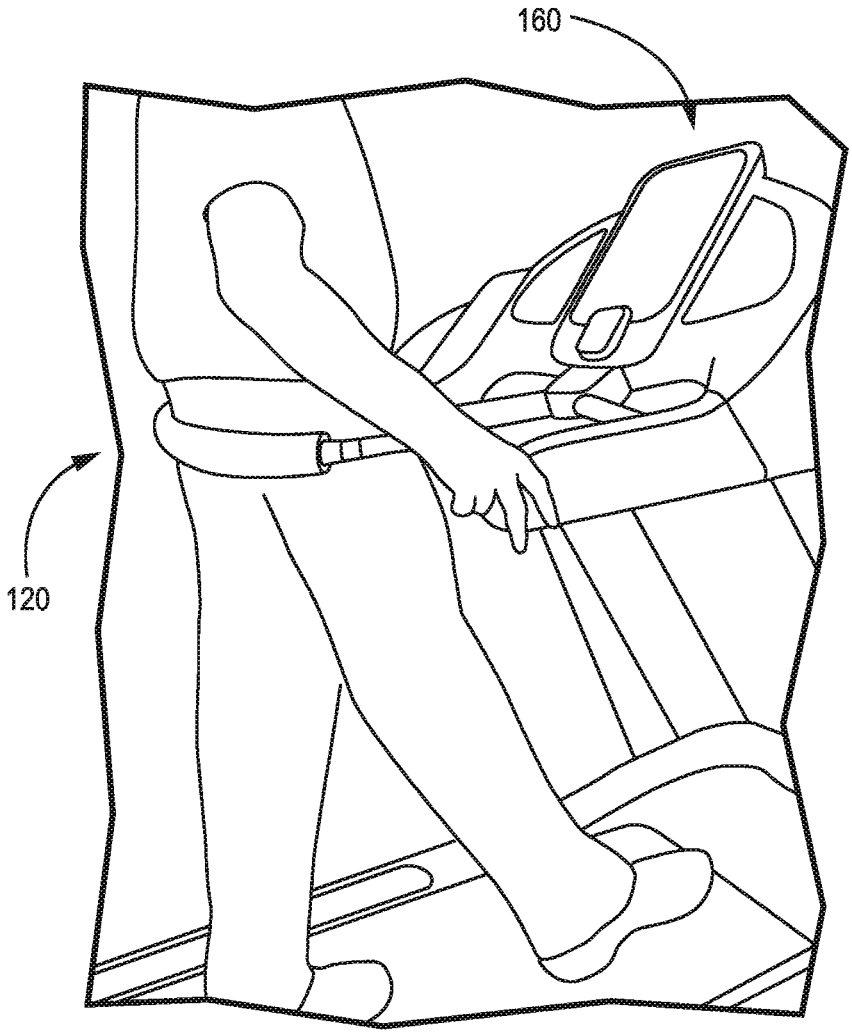
FIG. 11 shows the user of FIGS. 10A-10C walking on a treadmill with the treadmill comfort belt of FIGS. 10A-10C secured around the user's waist.

Referring to FIG. 11, in one embodiment, the treadmill comfort belt 120 disclosed herein supports the back side of a user. The treadmill comfort belt 120 is particularly beneficial for use with treadmills that are tilted upward by making it easier for a user to stay in place atop the tilted treadmill when walking and/or running. With the treadmill comfort belt 120 in place around the mid-section or waist of the user, the user may walk and/or run comfortably on the tilted treadmill without requiring the use of excessive energy to remain in place on the tilted treadmill.

Figure 12:
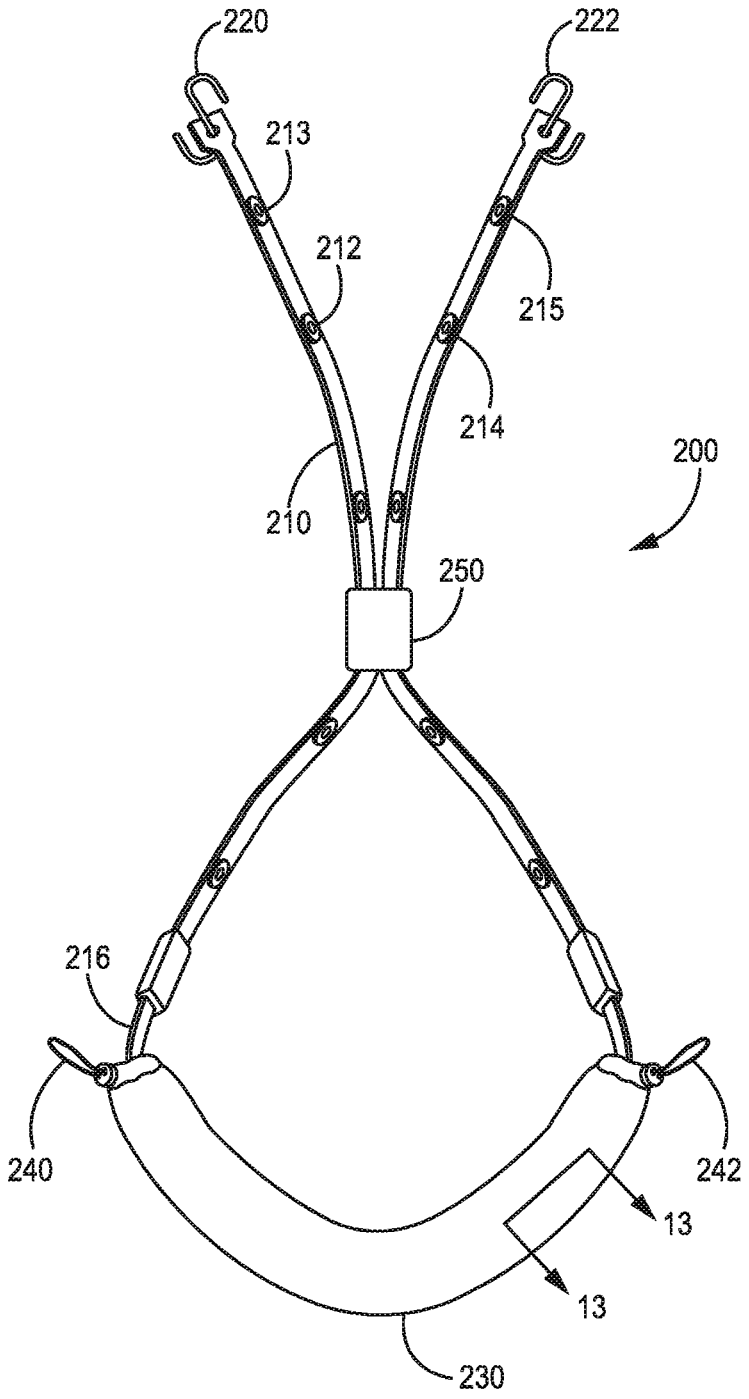
FIG. 12 shows a treadmill comfort belt according to an alternative exemplary embodiment of the present invention.

An alternative embodiment of a treadmill comfort belt 200 ("belt 200") is shown in FIG. 12. Belt 200 includes a strap 210 having a first end portion 212 and a second end portion 214. A lumbar support portion 216 is disposed between the first end portion 212 and the second end portion 214. Strap 210 can have a cross-section that is generally circular, flat, oblong, or other shape, as well as a combination of cross-sectional shapes along the length of strap 210.

In an exemplary embodiment, strap 210 can be constructed from an elastic material, such as, for example, a latex-free polymer or rubber having a length of about 96 inches and a width of about 0.75 inches.

A first securing member 220 is at an end of first end portion 212, distal from lumbar support portion 216. Similarly, a second securing member 222 is at an end of second end portion 214, distal from lumbar support portion 216. In an exemplary embodiment, securing members 220, 222 can be "S-shaped" hooks that can wrap around the handle of a treadmill as well as a respective end portion 212, 214. Securing members 220, 222 can be removed from strap 210 if desired.

Alternatively, end portions 212, 214 can each have a through-opening 213, 215 formed therein so that the securing members 220, 222 can be inserted into through-openings 213, 215. Although not shown, a plurality of through-openings 213, 215 can be provided at various distances along the length of strap 210 to provide for adjustability of the length of strap 210 relative to the treadmill.

Figure 13:
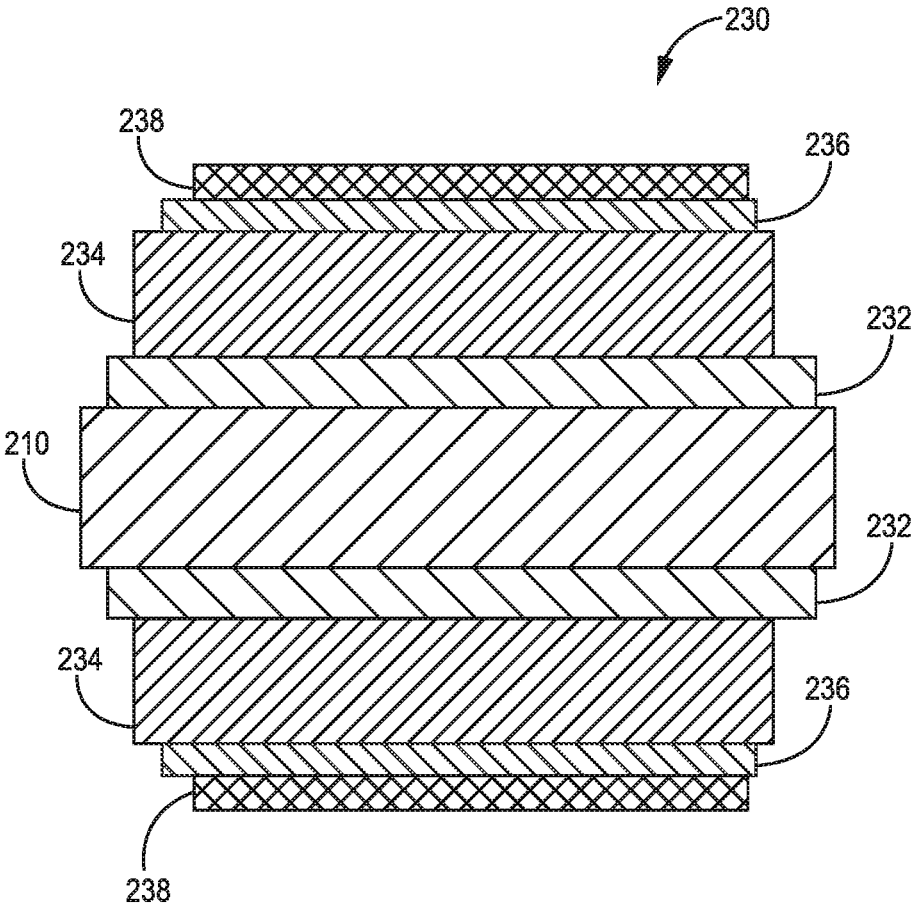
FIG. 13 shows a sectional view of the belt shown in FIG. 12, taken along lines 13-13 of FIGS. 12.

Lumbar support portion 216 includes a sleeve assembly 230 disposed there-over. Sleeve assembly 230 can be a layered assembly as shown in FIG. 13, starting with strap 210 extending though the center of sleeve assembly 230.

An anti-abrasion sleeve 232 can be provided over top of strap 210 to protect strap 210 as well as the interior of sleeve assembly 230 from being abraded due to stretching and relaxing of strap 210 during use. Anti-abrasion sleeve 232 can be constructed from vinyl, polyvinyl chloride, or other suitable material.

A lumbar support sleeve 234 is layered over anti-abrasion sleeve 232 and can be constructed from a compressible material, such as, for example, open-cell foam, to provide comfort to the user. Sleeve 234 can have an annular cross section with a central longitudinal opening sized to allow strap 210 to extend therethrough. In an exemplary embodiment, the cross section does not have any slits, holes, or other openings aside from the central longitudinal opening in order to provide support to the user.

A moisture barrier 236 can be applied over top of lumbar support sleeve 234. Moisture barrier 236 can be a press and seal self adhesive moisture impermeable polymer film applied to lumbar support sleeve 234 to prevent moisture and body odor from entering lumbar support sleeve 234.

A fabric sleeve 238 is disposed over moisture barrier 236. Fabric sleeve 238 can be constructed from a Spandex® material or a vinyl material and have drawstrings 240, 242 (shown in FIG. 12) at either end to tighten fabric sleeve 238 around lumbar support sleeve 234.

A collar 250 is slidingly disposed over the first end portion 212 and the second end portion 214 of strap 210 to secure belt 200 at the user's waist. The collar 250 is adapted to slide between the securing members 220, 222 and the sleeve assembly 230. Collar 250 can be constructed from rubber tubing having a length of about 2-¼ inches, an inside diameter of about 1 inch, and a well thickness of about ⅛ inch. Friction between collar 250 and strap 210 keeps collar 250 in a desired location after the user adjusts its location along strap 210. If desired, with securing members 220, 222 removed from strap 210 as discussed above, collar 250 can be slid along strap 210 to remove collar 250 from strap 210.

Figure 14:
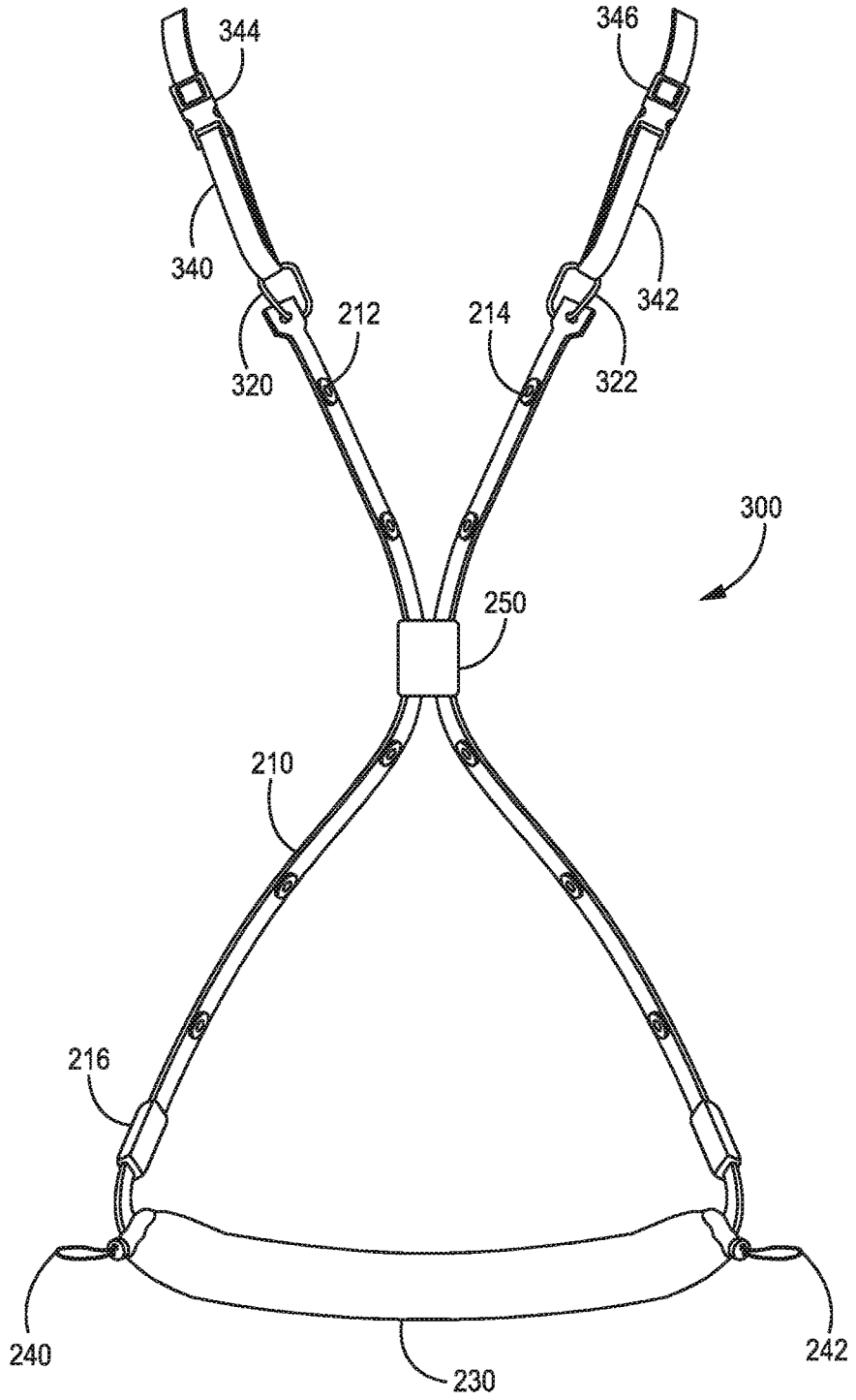
FIG. 14 shows a treadmill comfort belt according to another alternative exemplary embodiment of the present invention.

An alternative embodiment of a treadmill comfort belt 300 ("belt 300") is shown in FIG. 14. Belt 300 is similar to belt 200 with the exception that, instead of S-shaped hooks 220, 222, belt 300 uses carabiner clips 320, 322. A loop strap 340, 342 extends through each carabiner clip 320, 322, respectively.

Each loop strap 340, 342 includes a quick release latch 344, 346, respectively, to quickly disengage belt 300 from the treadmill in the event of an emergency. Each end of loop straps 340, 342 includes a component of latch 344, 346 so that, when the components are connected, loop straps 340, 342 form loops. Exemplary latches 344, 346 can be ¾ inch Side Release Buckle Straps constructed form heavyweight polypropylene, such as are provided by Strapworks of Eugene, Oreg.

Loop straps 340, 342 are sized to fit around the handle bar of a treadmill. Loop straps 340, 342 can also be adjustable in length, depending on the user.

In an exemplary embodiment of a method of using either belt 200 or belt 300, a user places belt 200 or belt 300 around the user's waist such that the lumbar support portion 230 engages the user's lumbar portion and the collar 250 is in front of the user.

If using belt 200, the user secures the first end portion 212 and the second end portion 214 around a handle bar of a treadmill and engages S-hooks 220, 222 to through-openings 213, 215, respectively in first and second end portions 212, 214, respectively. The user can then slide the collar 250 along the first end portion 212 and the second end portion 214 to adjust the length of the strap 210 around the user's waist. After the collar 250 is adjusted, the user can start the treadmill while holding onto the treadmill with at least one hand.

If using belt 300, the user wraps loop straps 340, 342 around the handle bar of the treadmill and secures quick release latches 344, 346. In the event that the user has to quickly disengage belt 300 from the treadmill, the user releases the quick release latches 344, 346, disengaging belt 300 from the treadmill.

While the foregoing is directed to embodiments of the present invention, other and further embodiments of the invention may be devised without departing from the basic scope thereof, which is only limited by the scope of the claims that follow. For example, the present invention contemplates that any of the features shown in any of the embodiments described herein, or incorporated by reference herein, may be incorporated with any of the features shown in any of the other embodiments described herein, or incorporated by reference herein, and still fall within the scope of the present invention.

We claim:

1. A treadmill comfort belt comprising:

a strap having:

a first end portion and a second end portion, each of the first end portion and the second end portion having a securing member; and a central strap portion disposed between the first end portion and the second endortion; a sleeve assembly disposed over the central strap portion, the sleeve assembly comprising: an anti-abrasion sleeve disposed over the central strap portion; a lumbar support sleeve disposed over the anti-abrasion sleeve; a moisture barrier disposed over the lumbar support sleeve; and a fabric sleeve disposed over the moisture barrier; and a collar slidingly disposed over the first end portion and the second end portion, the collar adapted to slide between the securing members and the sleeve assembly.

2. The treadmill comfort belt according to claim 1, wherein the securing members comprise S-shaped hooks.

3. The treadmill comfort belt according to claim 2, wherein the first end portion and the second end portion each have a hole extending therethrough, and wherein each S-shaped hook engages one of the respective holes.

4. The treadmill comfort belt according to claim 1, wherein the securing members comprise quick release latches.

5. The treadmill comfort belt according to claim 1, wherein the strap is constructed from an elastic material.

6. The treadmill comfort belt according to claim 1, further comprising an elongate loop extending from each of the securing members, wherein each elongate loop is sized to fit around a treadmill handle.

7. A method of stabilizing a user on a treadmill comprising the steps of:

(a) placing the belt according to claim 1 around the user's waist such that the sleeve assembly engages the user's lumbar portion and the collar is in front of the user;

(b) securing the first end portion and the second end portion around a handle bar of a treadmill;

(c) sliding the collar along the first end portion and the second end portion to adjust a length of the strap around the user's waist;

(d) starting the treadmill; and then (e) holding onto the treadmill with at least one hand.

8. The method according to claim 7, wherein the securing members comprise quick release latches and wherein the method further comprises the step of:

(f) releasing the quick release latches.

9. The method according to claim 7, wherein step (b) comprises engaging the securing members to their respective first and second end portions.

10. A treadmill comfort belt comprising:

an elastic strap having:

a lumbar support portion;

a first end portion connected to the lumbar support portion, the first end portion having a first plurality of slots formed therein; and a second end portion connected to the lumbar support portion, distal from the first end portion, the second end portion having a second plurality of slots formed therein;

a tension adjuster configured to extend through one of the first plurality of slots and one of the second plurality of slots, thereby connecting the first end portion and the second end portion;

a sleeve assembly disposed over the lumbar support portion;

a first connector extending from the first end portion, distal from the lumbar support portion; and a second connector extending from the second end portion, distal from the lumbar support portion; wherein the sleeve assembly comprises the following layers, extending outwardly from the lumbar support portion: an anti-abrasion sleeve; a compressible material; a moisture barrier; and a fabric cover.

11. The treadmill comfort belt according to claim 10, wherein the anti-abrasion sleeve comprises polyvinyl chloride.

12. The treadmill comfort belt according to claim 10, wherein the compressible material comprises open cell foam.

13. The treadmill comfort belt according to claim 10, wherein the moisture barrier comprises a self-adhesive film.

14. The treadmill comfort belt according to claim 10, wherein the fabric cover includes a drawstring.

15. The treadmill comfort belt according to claim 10, wherein each of the first connector and the second connector comprise a hook and wherein the first end portion and the second end portion each comprises a receiving portion adapted to receive one of the hooks.

* * * * *